US005193346A

United States Patent [19]

Kuwata et al.

[11] Patent Number: 5,193,346

[45] Date of Patent: Mar. 16, 1993

[54] PREMIXED SECONDARY FUEL NOZZLE WITH INTEGRAL SWIRLER

[75] Inventors: Masayoshi Kuwata, Ballston Lake; Cheryl Mele, Schenectady; Richard J. Borkowicz, Ballston Spa, all of N.Y.

[73] Assignee: General Electric Company, Schenectady, N.Y.

[21] Appl. No.: 899,586

[22] Filed: Jun. 18, 1992

Related U.S. Application Data

[63] Continuation of Ser. No. 618,246, Nov. 27, 1990, abandoned, which is a continuation-in-part of Ser. No. 501,439, Mar. 22, 1990, Pat. No. 4,982,570, which is a continuation of Ser. No. 934,885, Nov. 25, 1986, abandoned.

[51] Int. Cl.[5] ..... F23R 3/34; F02C 7/22

[52] U.S. Cl. ..... 60/737; 60/742; 239/403

[58] Field of Search ..... 60/39.465, 732, 733, 60/737, 738, 742, 748; 239/403, 461

[56] References Cited

U.S. PATENT DOCUMENTS

| | | | |
|---|---|---|---|
| 3,164,200 | 1/1965 | Reed | 239/403 |
| 3,703,259 | 11/1972 | Sturgess et al. | 60/742 |
| 3,713,588 | 1/1973 | Sharpe | 60/742 |
| 3,899,881 | 8/1975 | Arvin et al. | 60/737 |
| 4,023,351 | 5/1977 | Beyler et al. | 60/742 |
| 4,125,998 | 11/1978 | Barou et al. | 60/737 |
| 4,292,801 | 10/1981 | Wilkes et al. | 60/39.06 |
| 4,589,260 | 5/1986 | Krockow | 60/748 |
| 4,996,837 | 3/1991 | Shekleton | 60/748 |
| 5,039,018 | 8/1991 | Olsson | 239/403 |
| 5,054,280 | 10/1991 | Ishibashi et al. | 60/39.06 |

FOREIGN PATENT DOCUMENTS

| | | |
|---|---|---|
| 0108361 | 10/1983 | European Pat. Off. . |
| 0269824 | 6/1988 | European Pat. Off. . |

*Primary Examiner*—Richard A. Bertsch
*Assistant Examiner*—Timothy S. Thorpe
*Attorney, Agent, or Firm*—Nixon & Vanderhye

[57] ABSTRACT

A dual mode, dual stage low NOx combustor, includes a primary combustion chamber and a secondary combustion chamber separated by a throat region of reduced diameter. Fuel is input into the primary combustors by an annular array of diffusion type nozzles whereas in accordance with the invention, fuel is input into the secondary combustor by a central combination premix and diffusion nozzle. A premix swirler annulus is located upstream of a plurality of fuel distribution tubes of the combined premix and diffusion nozzle.

15 Claims, 3 Drawing Sheets

PREMIXED SECONDARY FUEL NOZZLE WITH INTEGRAL SWIRLER

RELATED APPLICATIONS

This is a continuation of application Ser. No. 07/618,246, filed Nov. 27, 1990, now abandoned, which is a continuation-in-part of application Ser. No. 07/501,439 filed Mar. 22, 1990 (now U.S. Pat. No. 4,982,570) which is a continuation of application Ser. No. 06/934,885 filed Nov. 25, 1986, now abandoned.

BACKGROUND OF THE INVENTION

This invention relates to gas turbine combustors; and, in particular, to improvements in gas turbine combustors for the further diminishment of air pollutants such as nitrogen oxides (NOx).

In an effort to reduce the amount of NOx in the exhaust gas of a gas turbine, inventors Wilkes and Hilt devised the dual stage, dual mode combustor which is shown in U.S. Pat. No. 4,292,801 issued Oct. 6, 1981 to a common assignee of the present invention. In this aforementioned patent, which is incorporated herein by reference, it was discovered that the amount of exhaust NOx could be greatly reduced, as compared with a conventional single stage, single fuel nozzle combustor, if there were two combustion chambers established such that under conditions of normal operating load, the upstream primary combustion chamber performed as a premix chamber whereas actual combustion occurred in the downstream second combustion chamber. Under this described operating condition, there would be no flame in the primary chamber resulting in a decrease in the formation of NOx. In this condition of operation, the secondary or center nozzle provides the flame source for the operation of the combustor. The specific configuration of the patented invention includes an annular array of primary nozzles each of which discharges into the primary combustion chamber and a central secondary nozzle which discharged into the second combustion chamber. These nozzles may all be described as diffusion nozzles in that each nozzle has an axial fuel delivery pipe and is surrounded at its discharge end by an air swirler which provides air for combustion to the fuel nozzle discharge.

In parent application Ser. No. 07/501,439, now U.S. Pat. No. 4,982,570, expressly incorporated herein by reference, the inventors discovered that further reduction in the production of NOx can be achieved by altering the design of the central or secondary nozzle such that it may be described as a combined premix and diffusion nozzle. In operation, a relatively small amount of fuel is used to sustain a diffusion pilot whereas a premix section of the nozzle provides additional fuel for ignition of the main fuel supply from the upstream primary nozzles directed into the primary combustion chamber.

In the above described invention, a premix swirler is located at the boundary of the secondary flame zone and serves to stabilize and hold the flame in various operating modes. This premix swirler component is, however, exposed to high flame temperatures which can impact the life of the swirler.

It is therefore an object of this continuation-in-part application to preserve the general configuration of the nozzle as described in the parent application while relocating the swirler so as to eliminate any direct contact with the flame. Accordingly, the premix swirler is now located upstream of the fuel injection point so that under no operating conditions will the swirler be in direct contact with the flame, thereby extending the life of the swirler.

SUMMARY OF THE INVENTION

The invention as described in the above identified parent application is especially applicable to gas turbine combustors of the type which include two combustion chambers separated by a venturi throat region. An annular array of primary nozzles discharge fuel into an upstream or primary combustion chamber. The method of operation dictates that while under base load, the primary nozzles are flamed out whereas the single central or secondary nozzle supports combustion of premix fuel from the primary nozzles. According to the invention, the single central or secondary nozzle, which has been characterized as a diffusion nozzle, is replaced by a diffusion piloted premix nozzle which reduces the fuel flow to the central diffusion flame from approximately 20 percent of the total fuel flow to about 2 percent of the total fuel flow for the entire combustor. This is done by installing an air delivery pipe around a minimal fuel delivery pipe to support the diffusion flame combustion whereas the maximum fuel delivery within the secondary nozzle occurs by way of radial fuel distribution tubes each of which discharge fuel into a premix chamber which surrounds the diffusion pilot comprising the axial fuel delivery pipe and its surrounding air delivery pipe. In this manner, a relatively minute amount of fuel, in a diffusion flame, may be used to ignite the central nozzle premix chamber flow but the amount required is considerably less than would be needed to ignite the main premix flow from the remaining surrounding primary nozzles. The design thus simultaneously minimizes the percentage of total fuel flow in the combustor that burns as a diffusion flame (with high NOx emissions) but allows sufficient heat input to ignite the main premixed flow by using the pilot premixed flow (which has low NOx emissions).

At the same time, the premix swirler component previously located at the boundary of the secondary flame zone is now relocated to a point upstream of the fuel injection point. Specifically, the premix swirler is made an integral part of the secondary fuel nozzle, and is located behind or upstream of the radial fuel distribution tubes. The swirler will preferably comprise a series of vanes circumferentially located at some angle with respect to the axial centerline of the fuel nozzle.

In another embodiment, a venturi is provided at the discharge end of the secondary premix chamber in order to assist in secondary flame stabilization.

Other objects and advantages of the present invention will become apparent from the detailed description which follows.

DETAILED DESCRIPTION OF THE DRAWINGS

Figure 1:
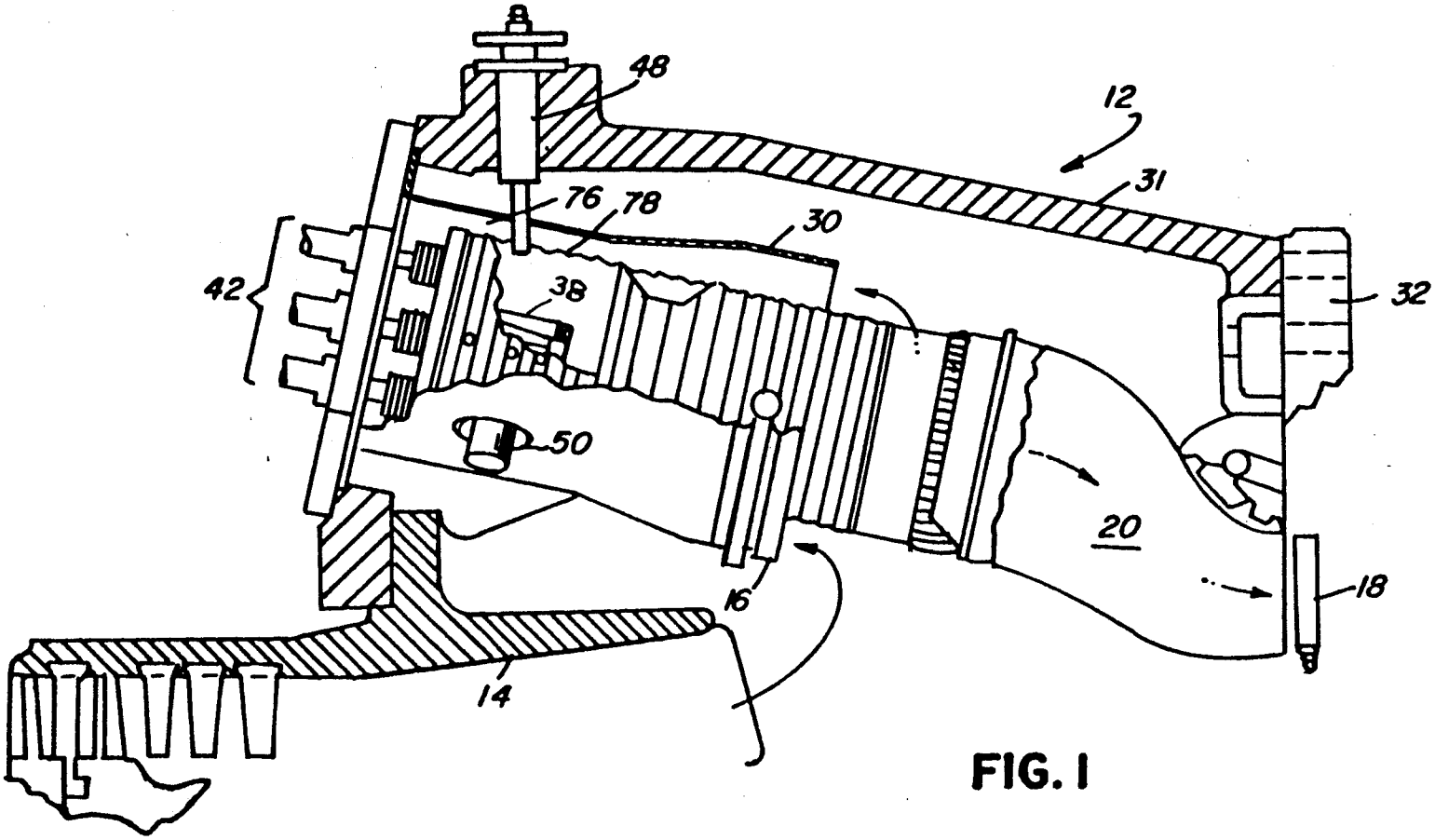
FIG. 1 is an elevation view of a gas turbine engine shown in partial cross section.

Referring to FIG. 1, a gas turbine 12 includes a compressor 14, a combustor 16 and a turbine 18 represented by a single blade. Although it is not specifically shown, it is well known that the turbine is drivingly connected to the compressor along a common axis. The compressor 14 pressurizes inlet air which is then turned in direction or reverse flowed to the combustor 16 where it is used to cool the combustor and also used to provide air to the combustion process. The gas turbine includes a plurality of the combustors 16 (one shown) which are located about the periphery of the gas turbine. In one particular gas turbine model there are fourteen such combustors. A transition duct 20 connects the outlet end 18 of its particular combustor with the inlet end of the turbine to deliver the hot products of the combustion process to the turbine.

Figure 2:
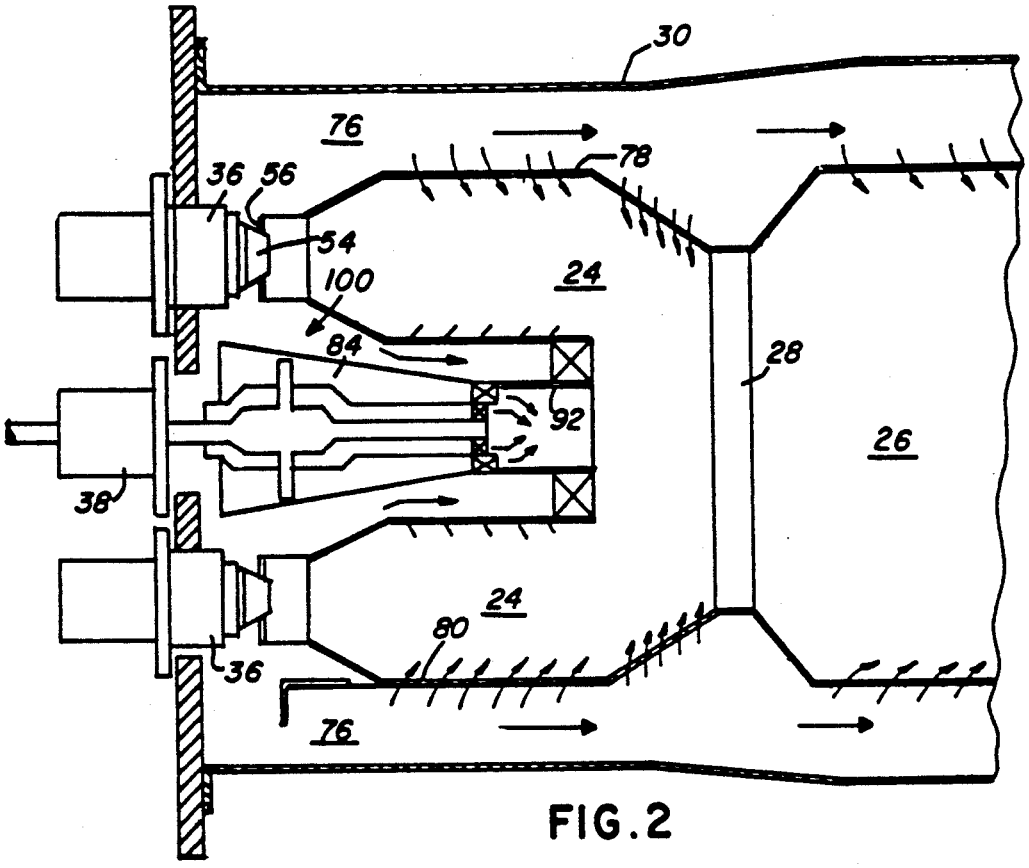
FIG. 2 is an enlarged detail elevation view of a combustor section of the gas turbine engine.

The invention is particularly useful in a dual stage, dual mode low NOx combustor of the type described in U.S. Pat. No. 4,292,801. As described in that patent; and, as shown in FIG. 2 herein, each combustor 16 comprises a primary or upstream combustion chamber 24 and a second or downstream combustion chamber 26 separated by a venturi throat region 28. The combustor 16 is surrounded by a combustor flow sleeve 30 which channels compressor discharge air flow to the combustor. The combustor is further surrounded by an outer casing 31 (FIG. 1) which is bolted to the turbine casing 32.

Primary nozzles 36 provide fuel delivery to the upstream combustor 24 and are arranged in an annular array around a central secondary nozzle 38. In one model gas turbine, each combustor may include six primary nozzles and one secondary nozzle. To complete the description of the combustor, fuel is delivered to the nozzles through plumbing 42 in a manner well known in the art and fully described in the aforementioned patent. Ignition in the primary combustor is caused by spark plug 48 shown in FIG. 1 and in adjacent combustors by means of crossfire tubes 50 also well known in the art.

In U.S. Pat. No. 4,292,801, it is pointed out that the fuel nozzles, both primary and secondary, are identical to one another; that is to say, the nozzles are all of the diffusion type. Referring to the present FIG. 2, a diffusion nozzle 36 includes a fuel delivery nozzle 54 and an annular swirler 56. The nozzle 54 delivers only fuel which is then subsequently mixed with swirler air for combustion. According to the patented teaching, the secondary nozzle is also a diffusion nozzle as will be explained further.

During base-load operation, the dual stage, dual mode combustor is designed to operate in a premix mode such that all of the primary nozzles 36 are simply mixing fuel and air to be ignited by the diffusion flame supported by the secondary or central diffusion nozzle 38. This premixing of the primary nozzle fuel and ignition by the secondary diffusion nozzle led to a lower NOx output in the combustor. However, there was at least one basic drawback to the system as described. For example, laboratory testing revealed that while utilizing the minimum possible percentage of fuel in the secondary nozzle minimized the NOx emissions at some operating conditions, the same low percentage of fuel in the secondary nozzle did not provide sufficient heat input to satisfactorily burn the main premixed flow at other operating conditions.

The inventors in parent application 07/501,439 now U.S. Pat. No. 4,982,570, discovered that a satisfactory pilot flame for the main premix flow from the upstream premix (primary) nozzles 36 may be sustained by using a minimal diffusion pilot in combination with a central nozzle premix chamber. Thus the invention simultaneously minimizes the percentage of total fuel in the combustor that burns as a diffusion flame (with high NOx emissions) while allowing sufficient heat input to ignite the main premixed flow by using the premixed secondary or pilot flow.

Figure 3:
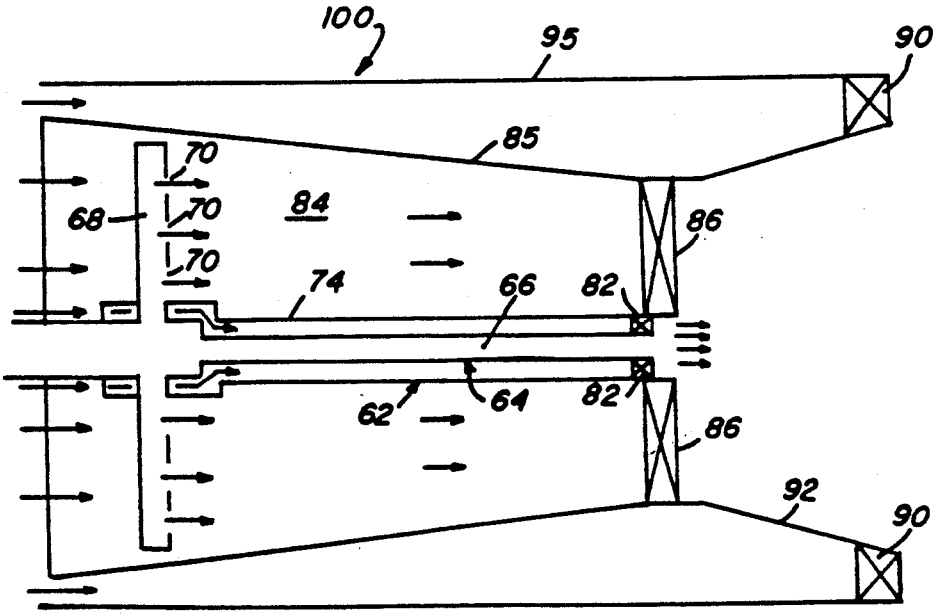
FIG. 3 is a schematic view of the combination diffusion and premix nozzle in accordance with the present invention.

Referring to FIGS. 2 and 3, a diffusion piloted premix (or secondary) nozzle 100 which is the subject of the parent application, is illustrated. The nozzle, also referred to as a secondary nozzle, includes a diffusion pilot 62 having a fuel delivery pipe 64. The fuel delivery pipe includes an axial pipe portion 66 and a plurality of radial, blind ended fuel distribution tubes 68 which extend radially outwardly from the axial pipe portion. In the preferred embodiment, there are six such fuel distribution tubes. As is most apparent from FIG. 3, the fuel distribution tubes each include a plurality of fuel discharge holes or orifices 70 which direct fuel downstream toward the discharge end of the combined nozzle. The fuel distribution holes are sized so as to obtain the desired percentage of fuel flow into the premix chamber to be hereinafter described.

The diffusion pilot 62 further includes an air delivery pipe 74 coaxial with and surrounding the fuel delivery axial pipe portion 66. The air input into the air delivery pipe 74 is compressor discharge air which is reverse flowed around the combustor 16 into the volume 76 (FIGS. 1 and 2) defined by the flow sleeve 30 and the combustion chamber liner 78. The diffusion pilot 62 includes at its discharge end a first or diffusion pilot swirler 82 for the purpose of directing air delivery pipe discharge air to the diffusion pilot flame.

A premix chamber 84 is defined by a sleeve-like truncated cone 85 which surrounds the diffusion pilot 62 and includes a discharge end (see flow arrows) terminating adjacent the diffusion pilot discharge end. Compressor discharge air is also reverse flowed into the premix chamber 84 from volume 76 in a manner similar to the manner in which air is supplied to the air delivery pipe 74. The plurality of radial fuel distribution tubes 68 extend through the air delivery pipe 74 and into the premix chamber 84 such that the fuel and air are mixed and delivered to a second or premix chamber swirler annulus 86 between the diffusion pilot 62 and the premix chamber truncated cone 85.

A third or central nozzle swirler 90 is located downstream from the discharge end of the secondary nozzle 100 between an extension or cup 92 on the discharge end of the pilot and the centerbody wall 95 of the primary combustion chamber. Compressor air is also reverse flowed to this swirler from the volume 76 surrounding the combustion liners. The purpose of this third swirler 90 is to provide stability for the diffusion and premix nozzle flame when combining with the primary premix flow from the primary combustor.

The required design of the first, second and third swirlers 82, 86 and 90, respectively, would be known to practitioners in the combustion art, and therefore requires no further description. The truncated cone 85 which defines the premix chamber 84, is formed of any metal suitable to use within a gas turbine environment.

Figure 4:
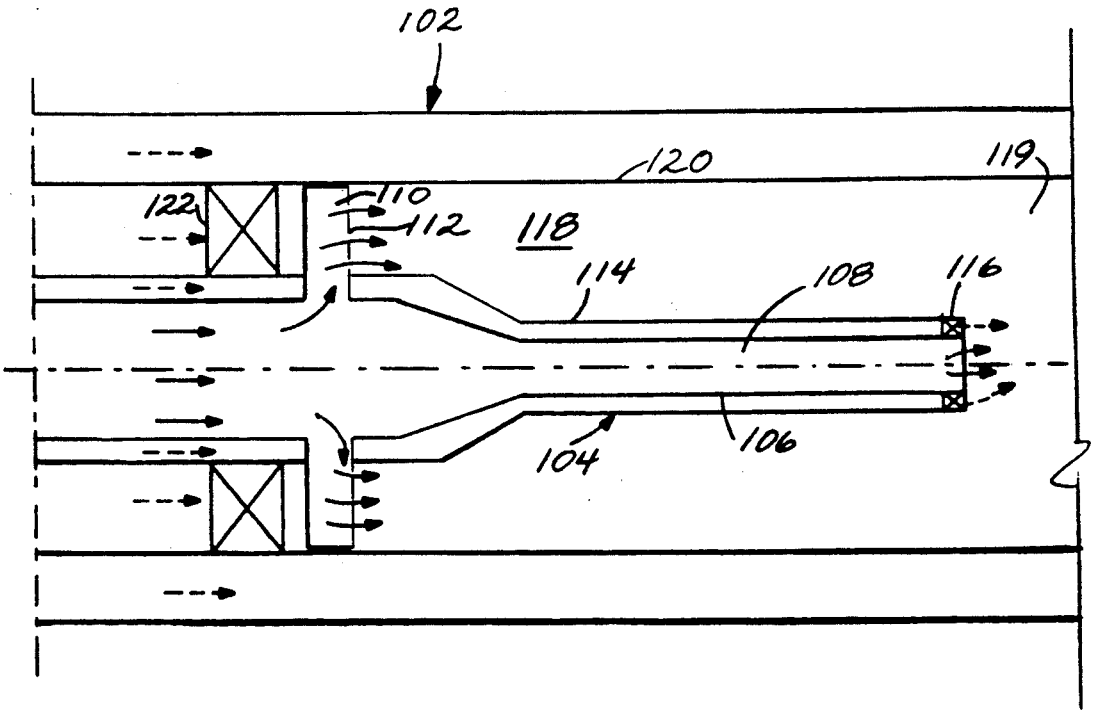
FIG. 4 is a schematic view of the combustion diffusion and premix nozzle in accordance with this continuation-in-part application.

Referring now to FIG. 4, a secondary nozzle 102 is illustrated in accordance with this continuation-in-part application. The diffusion piloted premix nozzle includes a diffusion pilot 104 having a fuel delivery pipe 106. The fuel delivery pipe has an axial pipe portion 108 and a plurality of radial fuel distribution tubes 110 which extend radially outwardly from the axial pipe portion 108 and which are closed at their outermost ends. As in the FIG. 3 embodiment, a preferred arrangement includes six such fuel distribution tubes. Each tube 108 also includes a plurality of fuel discharge holes or orifices 112 which direct fuel downstream toward the discharge end of the secondary nozzle. As previously discussed, the distribution holes 112 are sized so as to obtain the desired percentage of fuel flow into the premix chamber as described below.

The diffusion pilot 104 further includes an air delivery pipe 114 coaxial with and surrounding the fuel delivery pipe 106. The air input into the air delivery pipe 114 is compressor discharge air which is reverse flowed around the combustor as described above in connection with the embodiment illustrated in FIG. 3. The diffusion pilot 104 includes at its discharge end a first swirler annulus 116 for directing discharge air from the air delivery pipe into the diffusion pilot flame.

A premix chamber 118 is defined by a sleeve 120 which surrounds the diffusion pilot 104 and includes a discharge end 119 terminating adjacent the diffusion pilot discharge end, i.e., adjacent the first swirler 116. Compressor discharge air is also reverse flowed into the premix chamber 118 as described hereinbove. The plurality of radial fuel distribution tubes 110 extend through the air delivery pipe 114 and into the premix chamber. However, in this embodiment, the second swirler annulus 122 is located upstream of the radial fuel distribution tubes 110. By so locating the swirler 122, it is at no time subjected to direct flame contact thereby extending the life of the swirler, while retaining the function of the previously described swirler 86. In other words, the air flow is substantially similar to that described in the FIG. 3 embodiment in that the same degree of swirling of air and fuel is achieved so as to preserve the flame stability, but the danger of heat damage to the second swirler 122 is minimized. Thus, provided the flame characteristics are identical to the flame characteristics in the previously described embodiment, the result should be an identical or similar performance in premixed combustion as a whole.

In a presently preferred construction, the second swirler 122 will be an integral part of the secondary fuel nozzle 102, and the swirler will consist of a series of vanes circumferentially located at some angle with respect to the axial center line of the fuel nozzle as will be understood by those of ordinary skill in the art. The vanes may be cast as part of the nozzle or made separately and mechanically attached via welding or brazing to the nozzle. The vanes may be aerodynamic or non-aerodynamic so as to result in an aerodynamic flow or a separated flow from the vanes. While it is presently preferred to utilize a non-aerodynamic scheme, aerodynamic vanes may be utilized as well.

Figure 5:
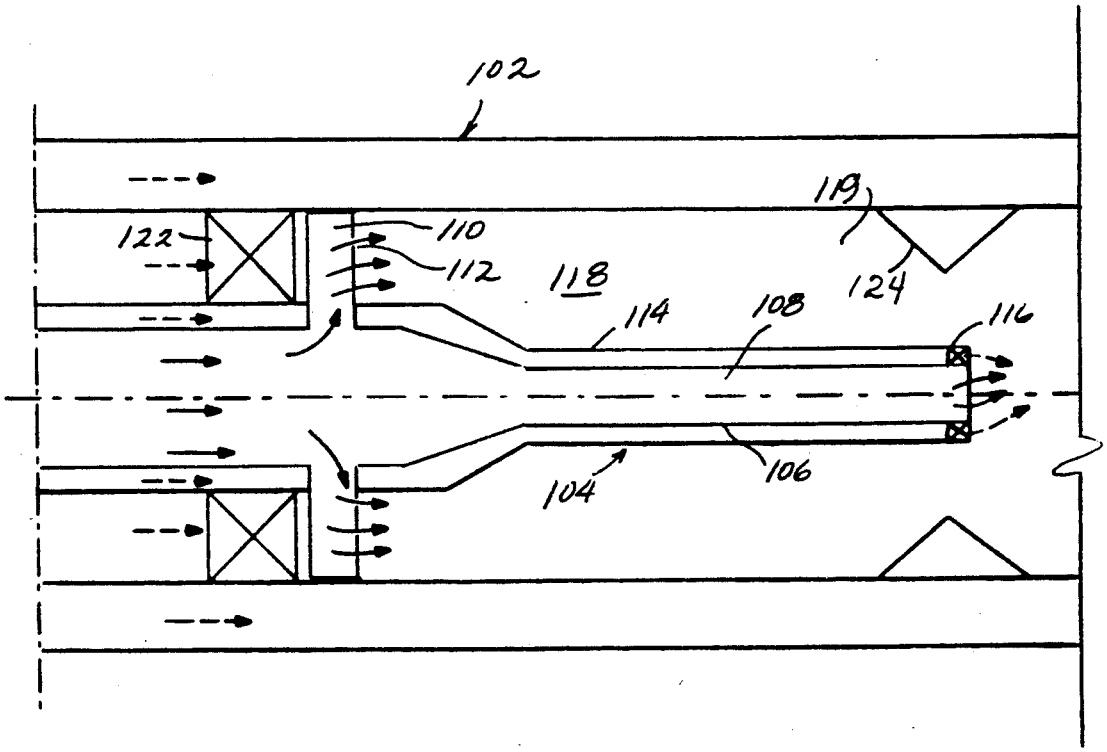
FIG. 5 is a schematic view of the diffusion and premix nozzle as shown in FIG. 4.

In the further embodiment illustrated in FIG. 5, a diffusion piloted premix nozzle is disclosed which is identical to that illustrated in FIG. 4 but with the addition of a venturi component 124 located at the end of the secondary premixing chamber. The venturi is not an integral part of the secondary fuel nozzle. The venturi 124 will supplement the swirl imparted by the upstream swirler 122 with a recirculating flow which will tend to enhance stabilization of the intense swirling flow.

In summary, the foregoing invention as described produces less NOx while providing an opportunity to add to the fuel flow through the secondary nozzle because of the lower NOx output whereas the turn down ratio or the ability to operate under varying conditions is considerably widened because the diffusion pilot is subject to the premix flow of the pilot rather than the total overall premix flow from the surrounding primary nozzles.

At the same time, the service life of the premix swirler previously located at the discharge end of the premix chamber has been enhanced by relocation upstream of the fuel injection orifices of the diffusion pilot.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A diffusion piloted premix nozzle comprising:

a sleeve;

a diffusion pilot within said sleeve and including a fuel delivery pipe having an inlet end and a discharge end, and an air delivery pipe;

said fuel delivery pipe further including a plurality of fuel distribution tubes;

a premix chamber surrounding the diffusion pilot and including an inlet end and a discharge end, the fuel distribution tubes extending into the premix chamber; and a premix air swirler mounted in said premix chamber upstream of said fuel distribution tubes, and surrounding said fuel delivery pipe and said air delivery pipe, wherein said air swirler is adapted to receive and swirl air in said sleeve external of said diffusion pilot.

2. The nozzle of claim 1 wherein said delivery pipe includes an axial portion having an inlet end and an outlet end, said plurality of fuel distribution tubes extending radially away from said axial portion.

3. The nozzle of claim 2 wherein the air delivery pipe extends substantially coaxially, and in surrounding relation to at least a portion of said fuel delivery pipe.

4. The nozzle of claim 2 wherein said radial fuel distribution tubes are located toward said inlet end of said premix chamber.

5. The nozzle of claim 2 wherein said fuel distribution tubes each have a plurality of fuel discharge orifices therein for discharging fuel toward said discharge end of said diffusion pilot.

6. The nozzle of claim 1 and including a venturi located adjacent the discharge end of the diffusion pilot.

7. A diffusion piloted premix nozzle comprising:

a sleeve;

a diffusion pilot within said sleeve and comprising a first axial fuel delivery pipe having an inlet end and a discharge end; an second axial air delivery pipe coaxial with the first axial fuel delivery pipe and surrounding the first axial fuel delivery pipe; and, a first swirler annulus disposed at the discharge end of the first axial fuel delivery pipe between the first axial fuel delivery pipe and the surrounding second axial air delivery pipe;

the first axial fuel delivery pipe further including a plurality of radial fuel distribution tubes extending outwardly from the first axial fuel delivery pipe and located toward the inlet end of the first axial fuel delivery pipe, the radial fuel distribution tubes extending beyond the circumference of the second axial air delivery pipe; and a second swirler annular upstream of said radial fuel distribution tubes, and mounted radially between said air delivery pipe and said sleeve, said swirler annulus adapted to receive air within said sleeve and external of said diffusion pilot.

8. A diffusion piloted premix nozzle according to claim 7 and further including:

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber.

9. A diffusion piloted premix nozzle according to claim 7, wherein said inlet of said second ar delivery pipe lies intermediate said inlet of the fuel delivery pipe and said plurality of radial fuel distribution tubes.

10. A diffusion piloted premix nozzle according to claim 7 wherein said second swirler annulus is integral with said nozzle.

11. A diffusion piloted premix nozzle comprising:

a diffusion pilot comprising a first axial fuel delivery pipe having an inlet end and a discharge end; a second axial air delivery pipe coaxial with the first axial fuel delivery pipe and surrounding the first axial fuel delivery pipe, said air delivery pipe having a discharge end substantially adjacent said fuel delivery pipe discharge end; and, a first swirler annulus disposed between the discharge ends of the first axial fuel delivery pipe and the surrounding second axial air delivery pipe;

the first axial fuel delivery pipe further including a plurality of radial fuel distribution tubes extending outwardly from the first axial fuel delivery pipe and located toward the inlet end of the first axial fuel delivery pipe, the radial fuel distribution tubes extending beyond the circumference of the second axial air delivery pipe; said second axial air delivery pipe having an air inlet end upstream of said radial fuel distribution tubes;

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber; and, a second swirler annulus at the inlet end of the premix chamber between the second axial air delivery pipe and a sleeve the surrounding premix chamber, and upstream of the radial fuel distribution tubes.

12. A diffusion piloted premix nozzle comprising:

a diffusion pilot comprising a first axial fuel delivery pipe having an inlet end and a discharge end; a second axial air delivery pipe coaxial with the first axial fuel delivery pipe and surrounding the first axial fuel delivery pipe; and, a first swirler annulus disposed at the discharge end of the first axial fuel delivery pipe between the first axial fuel delivery pipe and the surrounding second axial air delivery pipe;

the first axial fuel delivery pipe further including a plurality of radial fuel distribution tubes extending outwardly from the first axial fuel delivery pipe and located toward the inlet end of the first axial fuel delivery pipe, the radial fuel distribution tubes extending beyond the circumference of the second axial air delivery pipe; said second axial air delivery pipe having an air inlet end upstream of said radial fuel distribution tubes;

wherein said inlet of said second air delivery pipe lies intermediate said inlet of the fuel delivery pipe and said plurality of radial fuel distribution tubes; and a second swirler annulus at the inlet end of the premix chamber between the second axial air delivery pipe and the surrounding premix chamber, and upstream of the radial fuel distribution tubes, such that said second swirler annulus remains under all operating conditions out of direct contact with flame.

13. A diffusion piloted premix nozzle according to claim 12 and further including:

a premix chamber surrounding the diffusion pilot and including an inlet end and a discharge end, the radial fuel distribution tubes extending into the premix chamber;

at least one fuel discharge hole in each of said plurality of radial fuel distribution tubes, said at least one fuel discharge hole directed toward the discharge end of the premix chamber.

14. A diffusion piloted premix nozzle according to claim 12, and including a venturi located adjacent the discharge end of the fuel delivery pipe.

15. A diffusion piloted premix nozzle according to claim 12 wherein said second swirler annulus is integral with said nozzle.

* * * * *